United States Patent [19]

Thompson et al.

[11] Patent Number: 4,823,120

[45] Date of Patent: Apr. 18, 1989

[54] ENHANCED VIDEO GRAPHICS CONTROLLER

[75] Inventors: Laurence A. Thompson, Saratoga; Robin B. Moore, Fremont, both of Calif.

[73] Assignee: Apple Computer, Inc., Cupertino, Calif.

[21] Appl. No.: 906,753

[22] Filed: Sep. 12, 1986

[51] Int. Cl.[4] ..... G09G 1/28

[52] U.S. Cl. ..... 340/703; 340/799; 340/701

[58] Field of Search ..... 340/721, 703, 709, 745, 340/730, 767, 747, 798, 799, 701; 358/17; 364/521

[56] References Cited

U.S. PATENT DOCUMENTS

| | | | |
|---|---|---|---|
| 3,854,130 | 12/1974 | Ligocki | 340/703 |
| 3,961,134 | 6/1976 | Jarvis | 340/767 |
| 4,180,805 | 12/1979 | Burson | 340/709 |
| 4,200,867 | 4/1980 | Hill | 340/709 |
| 4,232,311 | 11/1980 | Agneta | 340/701 |
| 4,297,693 | 10/1981 | Parsons | 340/721 |
| 4,437,092 | 3/1984 | Dean et al. | 340/703 |

FOREIGN PATENT DOCUMENTS

| | | |
|---|---|---|
| 0112057 | 11/1983 | European Pat. Off. . |
| 0197846 | 3/1986 | European Pat. Off. . |
| 8400237 | 1/1983 | World Int. Prop. O. . |

*Primary Examiner*—John W. Caldwell, Sr.
*Assistant Examiner*—Alvin Oberley
*Attorney, Agent, or Firm*—Blakely, Sokoloff, Taylor & Zafman

[57] ABSTRACT

An enhanced video graphics controller for converting digital signals to a video signal is described. The controller is capable of displaying composite or analog RGB colors as well as providing shades of grey on monochrome displays. The processing of graphics information includes arranging 256 colors into 16 palettes of 16 colors each and is stored in a first memory. Pointers are assigned to each scan line of a frame of a display and these pointers are also stored in the first memory. Data fields which represent bit mapped video data are also stored in the first memory. For each scan line, a corresponding pointer is selected and this pointer selects one of the palettes to be loaded into a second memory. Then data field for that scan line address the second memory to provide color to the stored video data. The video controller is also capable of operating in several optional modes which include fill-in and dithering modes, as well as providing interrupts to update previous scan line information during the display cycle. Further, the controller is capable of enhancing existing displays by providing text and background color as well as providing a color border around the display.

21 Claims, 4 Drawing Sheets

ENHANCED VIDEO GRAPHICS CONTROLLER

BACKGROUND OF THE INVENTION

1. Field of the Invention

The present invention relates to the generation of video color signals from digital signals.

2. Prior Art

In the area of digital computer generated displays, there are many known forms of such displays. However, all such forms require the conversion of computer generated digital signals to a video signal compatible with a particular displaying device. A raster scanned display employing a viewing screen has become one of a predominant form of displaying the output of a computer.

With the emergence of personal computers and small business computers, several popular modes of digital-to-video signal conversion have been accepted as standards for use on color display devices. One such format is the composite color signal generation as described in U.S. Pat. No. 4,278,972. Another format is the generation of parallel control signals for red-green-blue (RGB) displays. The RGB displays have become more popular as their prices have declined and more importantly, they provide better color resolution over composite format displays.

The advent of RGB monitors and appropriate RGB conversion of digital signals have led to different techniques for further improving color resolution and the speed at which displays could be updated. Given certain design constraints which are inherent in the personal and small business computers, such as memory size and processor speed, as well as the display raster and pixel limitations, it is appreciated that very high resolution graphics is difficult to achieve.

Therefore, what is needed is an enhanced graphics controller for use with current generation of personal and small business computers which provides a larger variety of colors and update the video information at a faster rate. Such controllers would be used in conjunction with the current RGB monitors to provide an enhanced resolution video display. One resulting advantage of such a controller is its ability to provide for a more rapid movement of an object across the screen.

SUMMARY OF THE INVENTION

The present invention describes a method and apparatus for converting a digital bit string representing a color video signal to red, green and blue (RGB) color control signals for a color monitor. During loading memory cycles, digital signals representing graphics information are loaded into a memory. During display memory cycles, the controller reads graphics information from the memory and converts it to appropriate video signals for display on the screen.

Colors available for display are stored in the memory in palettes. Each palette contains a predetermined number of colors. For each line of the display, a specific palette is chosen such that the colors stored in the palette are the only available colors for representation on that particular line. The graphics information, which is sectioned into color fields, selects colors for a predetermined number of consecutive pixels. Therefore, all the pixels of a particular scan line chooses colors from a preselected color palette, wherein each color is determined by bits arranged into red, green and blue color fields. This color sectioning technique involving palettes and color fields, allows a variety of colors to be chosen from a small number of controlling bits.

The present invention also provides for a color fill mode, wherein color field information need not be updated if the color of the subsequent color field does not change on the display. Further, the present invention teaches a method of dithering pixels to provide for color variations which are not within the palette selected. Also, the present invention provides for an interrupt scheme which permits updating of the previous line while still in the video display mode.

In addition to the new video display, the present invention is capable of providing prior art RGB and composite video displays which are well-known to a generation of Apple II computers. The present invention not only provides this prior art video, but is capable of enhancing presentation of the present video by providing such enhancements as gray scale and separate borders colors, and colored text and background.

DETAILED DESCRIPTION OF THE PRESENT INVENTION

The present invention describes a method and apparatus for converting digital graphics information to video signals as used on a RGB monitor. In the following description, numerous specific details are set forth, such as specific number of bits, number of colors, etc., in order to provide a thorough understanding of the present invention. It will be obvious, however, to one skilled in the art that the present invention may be practiced without these specific details. In other instances, well-known methods and structures have not been set forth in order not to unnecessarily obscure the present invention.

The present invention is currently realized as part of a computer system, more specifically, a personal computer or a small business computer. Because the present invention is readily adaptable to most any such computer system, only the architecture of the present invention is described. However, it is appreciated that those skilled in the art may readily practice the invention with knowledge of prior art computer systems.

Figure 1:
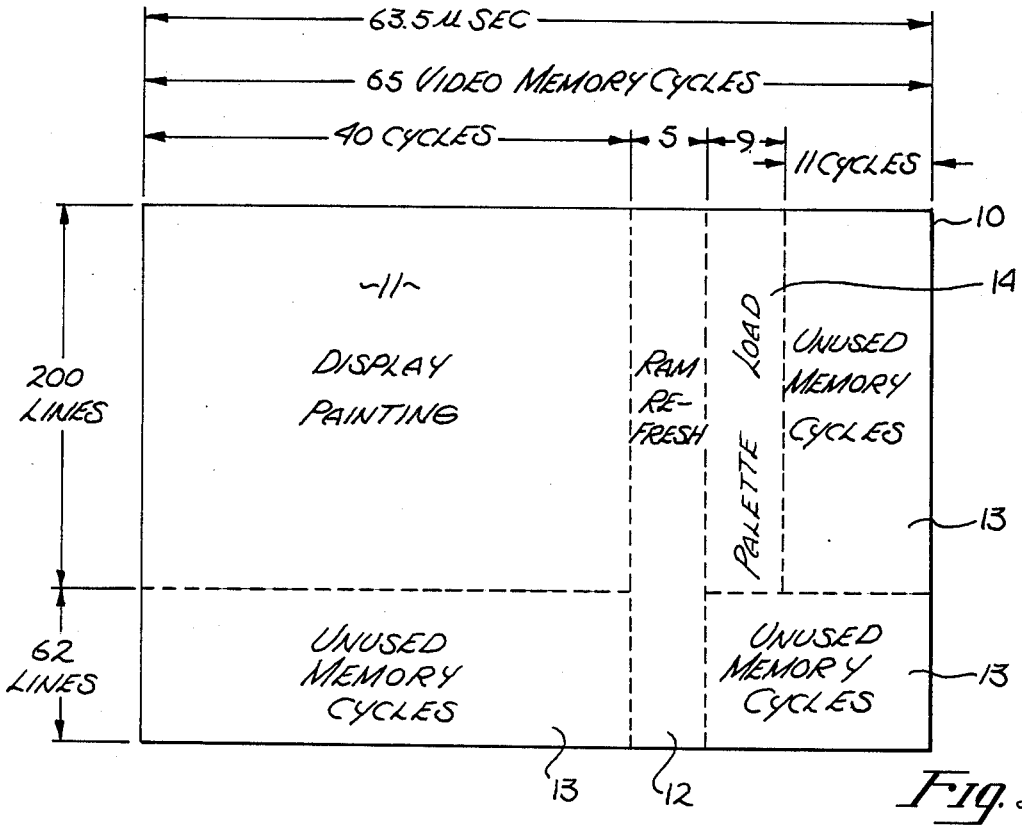
FIG. 1 is a graphic representation of video memory cycles of a single frame of the present invention.

Referring to FIG. 1, a bus activity cycle of a single video frame 10 is illustrated as a map. A line of frame 10 is 65 video memory cycles long, having a duration of 63.5 microseconds. There are actually 130 memory cycles in 63.5 microseconds. Half or 65 of these are reserved for microprocessor access to memory. The other 65 are for display (video) and refresh as illustrated in FIG. 1. The microprocessor and video cycles are interleaved so that microprocessor cycles alternate with video cycles.

The 65 video memory cycles are separated into three groupings. Forty cycles are used for display painting 11, at which time the stored video is displayed, such as on a viewing screen. During inactive portion of the display, such as during horizontal blanking, the bus is allotted the remaining 25 cycles for other use. Five cycles are used for random-only-memory (RAM) refresh 12, and nine cycles are used to load color palettes, leaving 11 memory cycles for use in other memory operations. The vertical mapping shows 262 scan lines, wherein 200 are used for display painting 11, and 62 lines are reserved for other uses during vertical blanking. Therefore, regions 13 map time periods when the memory is available other than for display painting 11, RAM refresh 12 or palette loading 14. Although the preferred embodiment has specific number of scan lines and memory cycles for a particular function, such numbers are strictly arbitrary, and normally determined by a designer in configuring a desired system. It is appreciated that these features can be changed without departing from the spirit and scope of the invention.

Figure 2:
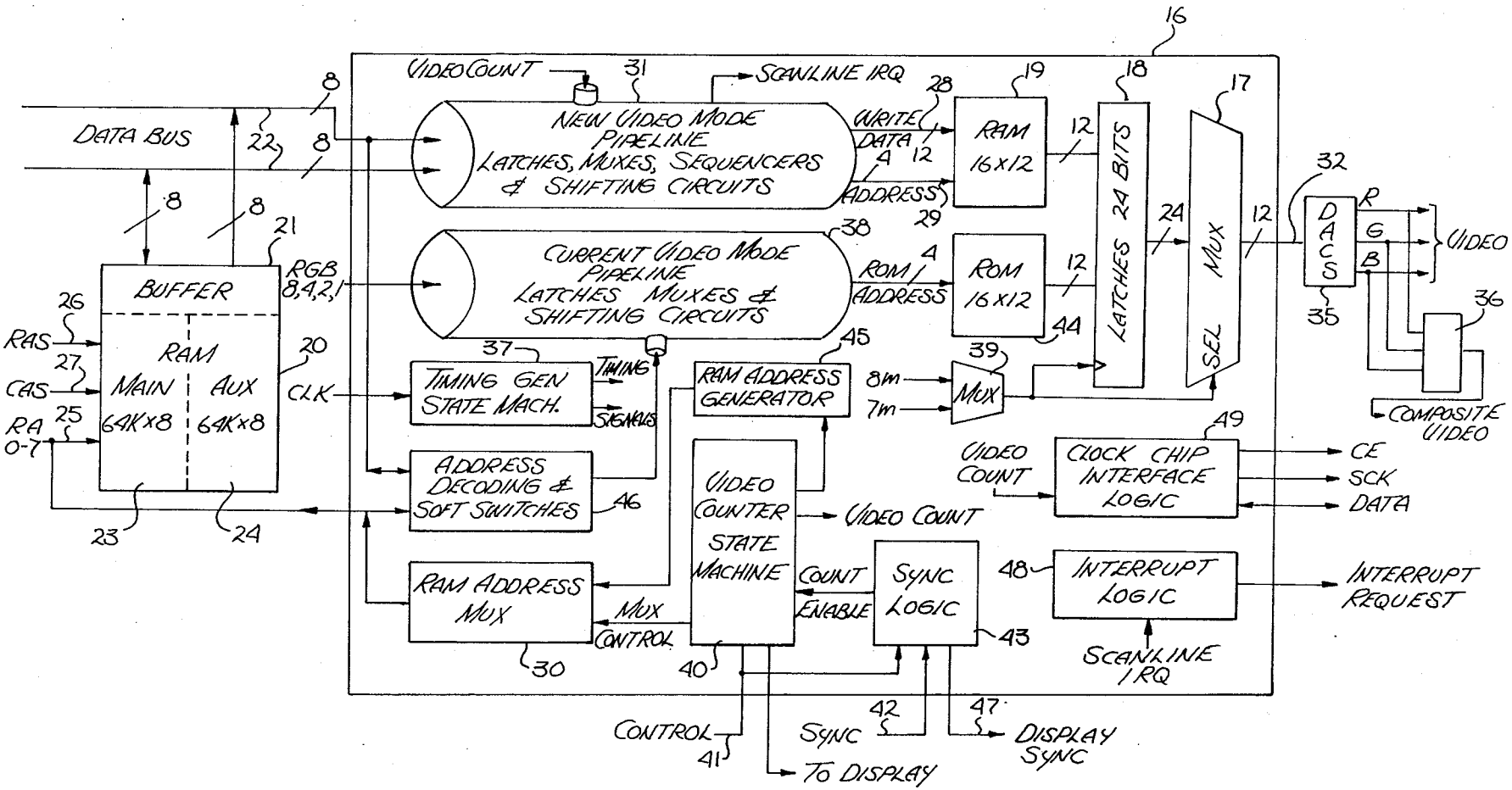
FIG. 2 is a block diagram of the circuit of the present invention.

Referring to FIG. 2, a basic block diagram of the preferred embodiment is shown. A RAM 20, including a buffer 21 is shown coupled to a data bus 22. RAM 20 includes a pair of 64K×8 memory divided into two 8-bit logical sections 23 and 24. Data bus 22 is a 16-bit bus providing an even 8-bit byte and an odd 8-bit byte which provide a 16-bit word. Although two 64K×8 memory provide the physical memory, sections 23 and 24 are strictly logical and terms Main and Aux (for auxiliary) are provided for reference only.

RAM 20 is addressed by a RA0-7 address line 25, RAS line 26 and CAS line 27. Data bus 22 forms a 16-bit wide path and during one video memory cycle, Main 23 and Aux 24 are read twice using page mode CAS. These two reads of a 16-bit wide memory provide 32-bits per memory cycle. RAM 20 is also addressed by RAM address MUX 30. MUX 30 provides RA0-7 address locations, but uses RAS and CAS signals provided on lines 26 and 27. Although a particular RAM is shown, a variety of memory devices can be used.

Data bus 22 is coupled to a new video mode pipeline 31. Pipeline 31 includes a plurality of latches, muxes, sequencers and shifting circuits having various data manipulation functions for converting data on lines 22 to a 12-bit data on line 28 and a 4-bit address on line 29. The parallel 12-bits of data on lines 28 are for writing digital RGB signal information into RAM 19, which in the preferred embodiment is a 16×12 RAM. The sixteen addresses of RAM 19 are selected by the 4 bits on address line 29. A parallel 12-bit output from RAM 19 is coupled to 24-bit latches 18 and the output of latches 18 is coupled through MUX 17 to provide a 12-bit RGB signal to digital-to-analog converters (DACs) 35. The digital RGB signal is converted to an analog RGB video signal. Further, the analog RGB is combined to provide a composite NTSC signal by circuit 36.

A video counter state machine 40 is coupled to a microprocessor or other control lines 41 and a video sync line 42 is coupled to sync logic circuit 43. Control line 41 is also coupled to sync circuit 43. Lines 41 and 42 provide the necessary control and synchronization signals to maintain proper timing between the video circuits, the microprocessor and other system circuits. Sync circuit 43 initializes video counter 40, as well as provides display sync on line 47. Video counter 40 provides the count of each of the 65 video memory cycles illustrated in FIG. 1. Video counter 40 also enables RAM address generator 45, controls RAM address MUX 30, and controls the viewing display.

MUX 30 couples address information on RA0-7, which is also coupled to address decoding and soft switches circuit 46. Circuit 46 is coupled to data bus 22 for input to pipeline 31. Circuit 46 is also coupled to provide control signals for a current video mode pipeline 38.

Current video mode pipeline 38 is comprised of latches, multiplexers and shifting circuits to accept a RGB 8421 signal and generating a 4-bit address signal to access one of sixteen 12-bit color signals stored in ROM 44. ROM 44 of the preferred embodiment is a 16×12 ROM, wherein the output is coupled to latches 18 and then to MUX 17 for output to DACs 35. It is appreciated that other memory devices, such as a RAM, can be used in place of ROM 44.

A timing generator state machine 37 accepts a system clock signal and generates necessary timing signals for the video circuits. Timing generator 37 also generates a 8 MHz and a 7 MHz signal which is coupled to MUX 39. MUX 39 selects the 7 MHZ signal when current video mode is desired and selects the 8 MHz signal when new video mode is desired. The output of MUX 39 clocks latches 18 and MUX 17 to generate either a 7 MHz or a 8 MHz digital RGB signal to DACs 35.

An interrupt logic circuit 48 accepts a scanline interrupt request and generates appropriate interrupt requests to the system. Further, a real time clock chip interface logic circuit 49 is coupled to the video counter 40 and to the system and is used to transfer information between the microprocessor and the clock chip and is not essential to the function of the video circuit.

In FIG. 2, the rectangular area enclosed by line 16, encompass those circuits which are incorporated on a single integrated circuit chip. Although the present invention may be implemented in various forms, one intent of the preferred embodiment is to integrate complex video circuits into a single semiconductor chip. Further, it is appreciated that various devices and circuits can be used to practice the present invention without departing from the spirit and scope of the invention.

The present invention is capable of functioning in several color graphics processing environments, two of which are well-known to the generation of popular personal computers known as Apple II. The first method utilizes an NTSC color (chroma) composite video signal as described in U.S. Pat. No. 4,278,972. The second method is the well-known analog RGB (red-green-blue) video. However, both of these types of video signals are generated from the parallel 12-bit digital RGB signal on line 32. Therefore, it is the generation of the digital RGB signal on line 32 which provides the necessary digital video information. The preferred embodiment uses a parallel 12-bit digital RGB signal, but the number of bits may be changed without departing from the spirit and scope of the invention.

PROCESSING OF CURRENTLY USED VIDEO MODES

A method of generating a special color signal known as RGB 8421 is described in a U.S. patent application, entitled "Method and Apparatus for Generating RGB Color Signals from Composite Digital Video Signal", Ser. No. 785,220, filed Oct. 7, 1985, U.S. Pat. No. 4,786,893 and which is assigned to the assignee of the present invention. This currently used RGB 8421 signal is coupled to the current video mode pipeline 38 of FIG. 2. The 4-bit RGB 8421 color signal functions to address the ROM 44 which stores sixteen predetermined 12-bit signals to data latches 38 for output on line 32.

If text is selected for display, the text information for each frame which is generated by a character generator (not shown) is stored in RAM 20. During display mode, the text data are inputted to pipeline 38 and processed to generate a 4-bit ROM address signal to ROM 44. If graphics is desired, then graphics information is stored in RAM 20 and then inputted into pipeline 38 using well-known circuits not shown in FIG. 2. Pipeline 38 is comprised of well-known prior art circuits which converts RGB 8421 video signals to a parallel 4-bit signal for selecting one of the colors in ROM 44.

ENHANCING OF CURRENTLY USED VIDEO MODES

Figure 6:
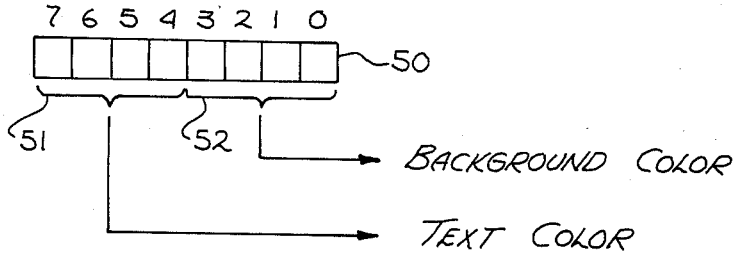
FIG. 6 shows a bit sequence in a text/background register.

Referring to FIGS. 2 and 6, a text/background register 50 located in RAM 20 is shown in FIG. 6. Register 50 is an 8-bit register where the four most significant bits 51 select the color of the text and four least significant bits 52 select the background color. The 8-bits of register 50 are coupled to address decoding and soft switch circuit 46, wherein the information is passed to control pipeline 38. Each four bits selects one of 16 colors in ROM 44 for background and one of 16 colors in ROM 44 for text. Once set the register 50 need not be changed unless different colors are needed for background or text. On reset, the default is to white text on a black background.

Figure 7:
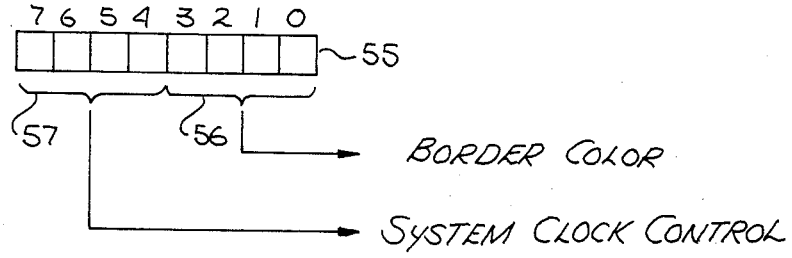
FIG. 7 shows a bit sequence in a border color register.

Referring to FIGS. 2 and 7, the four least significant bits 56 of a border color register 55 located in RAM 20 selects a color to be used to border the edges of the display. Circuit 46 accepts bits 56 and generates appropriate control signals to pipeline 38 to select one of 16 colors stored in ROM 44. On reset the default is to black. The remaining four bits 57 are reserved for system clock control and are not essential to the color functions.

Video counter 40 and RAM address generator 45 through MUX 30 and circuit 46 maintain accurate count of lines and pixels. Counter 40 counts each video cycle to maintain pixel count and RAM address generator 45 maintains line count for each line of the display.

Therefore, the present invention is capable of enhancing existing color modes by selecting sixteen colors for the text and background, as well as providing a color to border the display screen.

PROCESSING OF NEW VIDEO MODES

Figure 3:
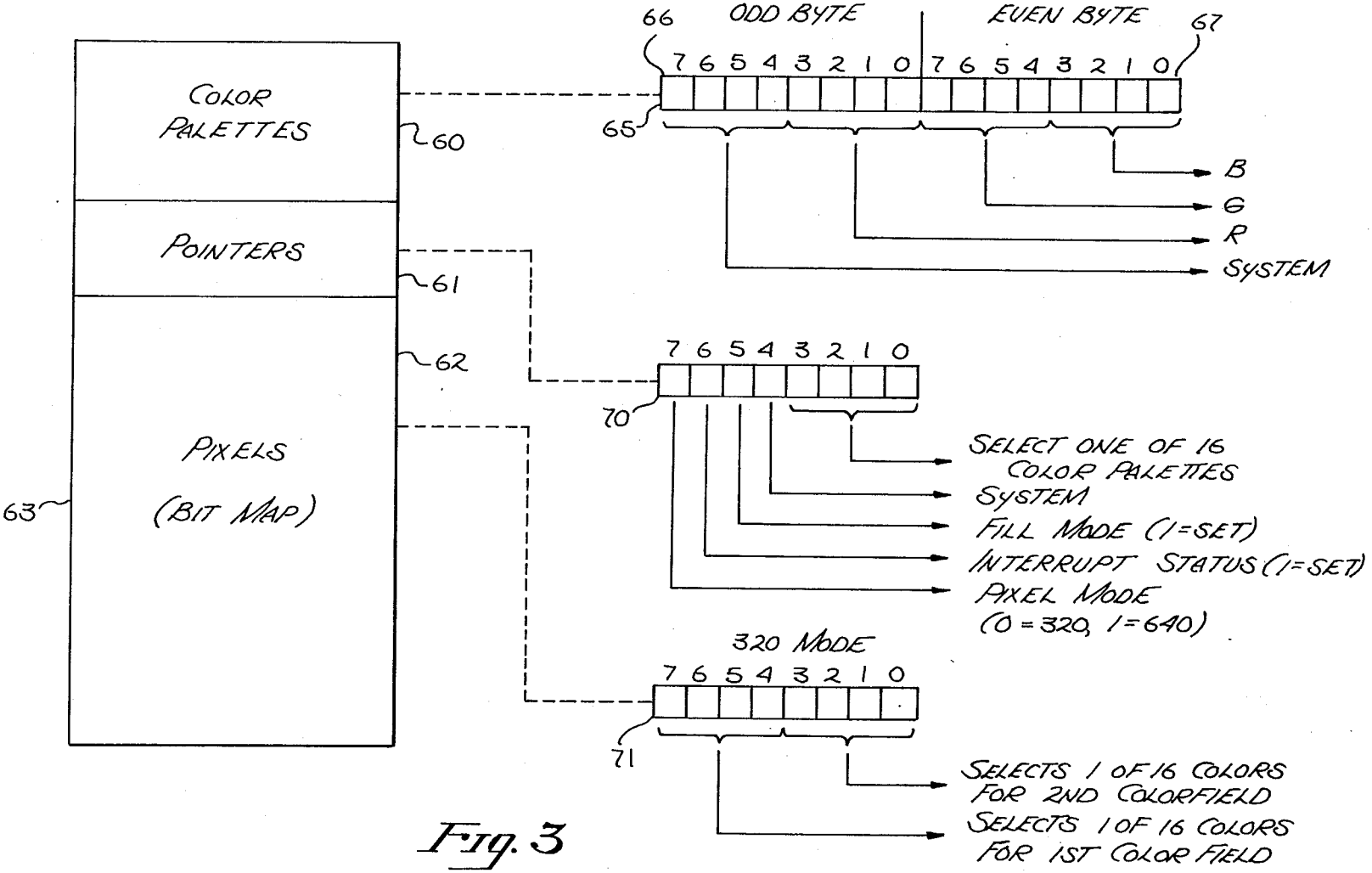
FIG. 3 is a memory map representing the data for the color palettes, pointers and pixels as used in the present invention, as well as bit information associated with each byte of the data.

Referring to FIGS. 2 and 3, a portion of RAM 20 of FIG. 2 is shown as memory 63. Memory 63 is emplyed as a display buffer in the new video mode of the present invention. Memory 63 is divided into three segments 60–62 to retain three types of data. Segments 60–62 need not be contiguous.

Further, the term "color field" is used to describe a predetermined number of pixels controlled by each four bit string of byte 71. Simply, in 320 mode there are 320 color fields for a given scan line. For example, if there are 320 pixels in a scan line of a display, then each color field will control the color of one pixel. However, if there are 640 pixels per scan line of a display, then each color field will control two consecutive pixels of each scan line. The option of selecting a given number of pixels per color field is determined by the display system used.

Color palette segment 60 stores a plurality of color palettes which provide the color information. Each "color" is a bit string, when converted to the digital RGB format, generates a specific color on the display. Segment 60 of the preferred embodiment is capable of storing 256 different colors organized into 16 palettes, wherein each palette contains 16 colors. One color palette, or one set of 16 color words, is loaded into the RAM 19 during the horizontal blanking time for each scan line. Each color is represented as a word 65 stored in segment 60. The color word 65 of the preferred embodiment has an odd byte 66 and an even byte 67. Least significant four bits of byte 67 contain the B color information, most significant four bits of byte 67 contain G color information and least significant four bits of byte 66 contain R color information. The most significant four bits of byte 66 are reserved for system use and are not used for color determination. Therefore, each color word is a 12-bit string stored in color palette segment 60.

A palette is loaded during the palette load cycles of the video memory cycles. In the preferred embodiment, four bits have been chosen for each of the R, G and B signals so that 4096 colors can be chosen as the output on lines 32. The sixteen colors of a particular palette are loaded into RAM 19 on lines 28.

Segment 61 is designated as the pointer segment and is loaded with pointer information at anytime using processor memory cycles. Each pointer is comprised of an 8-bit pointer byte 70. Segment 61 is loaded with an 8-bit byte 70 for each line of the display. Therefore, the preferred embodiment has 200 pointer bytes 70, although the number can vary depending on a particular system. For each scan line of the display, the least significant four bits select one of the 16 color palettes in segment 60. Bit 5 of byte 70 is used to set the fill mode, wherein a value of one for this bit position sets the fill mode. Bit 6 of byte 70 is used to set the interrupt status and bit 7 of byte 70 is used to set the pixel mode. Bit 4 of byte 70 is reserved for system usage. The functions of bits 5, 6 and 7 of byte 70 will be described later.

Pixel segment 62 of memory 63 contains the pixel information in a bit map format. Pixel information for a complete frame of a display is loaded into segment 62. The graphics information in segment 62 is stored in a consecutive byte format to provide a bit map for a frame of the display. Byte 71 illustrates the arrangement of graphics information as stored in segment 62. Byte 71 is shown in 320 mode. When 320 mode is desired, bit 7 of byte 70 of pointer segment 61 is set to zero. In 320 mode, byte 71 is separated into two 4-bit segments. A most significant four bits of byte 71 are used to select one of 16 colors from a predetermined palette which has been loaded into RAM 19 for the first color field. The least significant four bits are used to select one of 16 colors from the same palette for the second color field. The next adjacent byte (not shown) to byte 71 in the linearly mapped pixel segment 62 selects color information for the next two sets of color fields from the palette loaded in RAM 19.

The selection of a color from RAM 19 for each color field continues on address line 29 until the end of the scan line at which time the MUX 30 and circuit 46 select the next pointer byte within segment 61, which in turn selects one of 16 available color palettes from palette segment 60 and loads it into RAM 19 for use in the following scan line. Data in memory 63 is changed or updated at anytime by the processor using memory cycles reserved for the processor.

Figure 4:
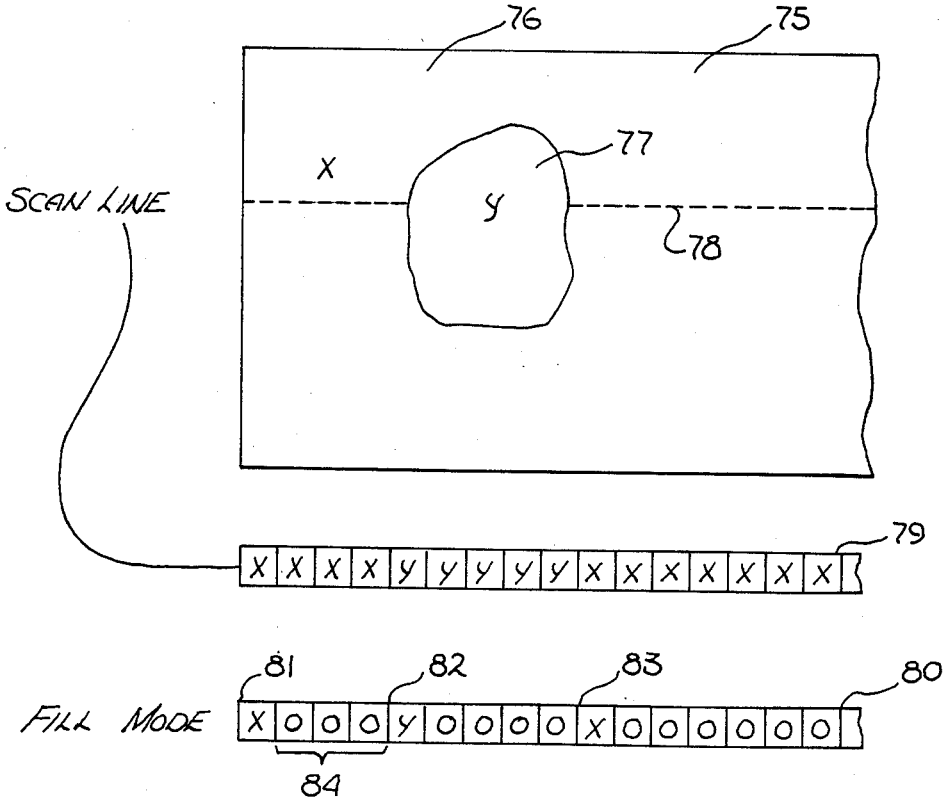
FIG. 4 is a pictorial representation of a portion of a scan line of a display and also showing pixel and bit strings relating to the use of a fill mode.

Referring to FIGS. 2 and 4, a function of the fill mode is illustrated. In this hypothetical example, display 75 shows an object 77 having a designated color Y upon a background 76 having a designated color X. A given scan line 78 which transcends from color X to color Y and again back to color X is shown. In normal operation, a color instruction must be provided for each color field as shown in color field string 79. In string 79, each color field must be read and then each color must be accessed by the color fields. That is, for each pixel, a color field information must be read from memory and its respective color must be accessed.

However, when color fill mode is utilized by setting bit 5 of byte 70 of FIG. 3 to one, color field information is only needed at transition points 81, 82 and 83. A color field string utilized in the fill mode is illustrated in field string 80. Here, color X is selected at transition point 81. If subsequent color fields do not change the color information, then there is no need for each color field to access the palette as though a new color is being introduced. Therefore, when color fields are read and no color field change is detected by pipeline 31, it will repeat the 4-bit address to RAM 19. This repetition of RAM 19 address is performed until another color is detected at transition point 82. After the new color Y is read from the palette in RAM 19, subsequent color fields will be filled in until another transition is detected at transition point 83. The color fill mode reduces memory cycles to display a color, because RAM 19 address need not be rewritten unless the color changes. Pipeline 31 need not write a new address on lines 29 until transition points 81, 82 and 83 occur.

In the preferred embodiment, the fill mode is selected when bit 5 of byte 70 of FIG. 3 is set to one. However, instead of comparing previous color words to determine a color transition, the preferred embodiment performs the fill in when color field bits of byte 71 are set to zero. Therefore, instead of making a determination of a color field transition, the pipeline 31 only needs to read the value of zero in the color field. A device, such as a multiplexer (not shown), permits a color field to pass when a value of a color field of byte 71 is non-zero. When the value is a zero, the multiplexer blocks the zero valued color field and recirculates the previously used color field. Because zero color is used for signalling a "fill-in", only 15 colors are actually available when operating in the fill mode.

Figure 5:
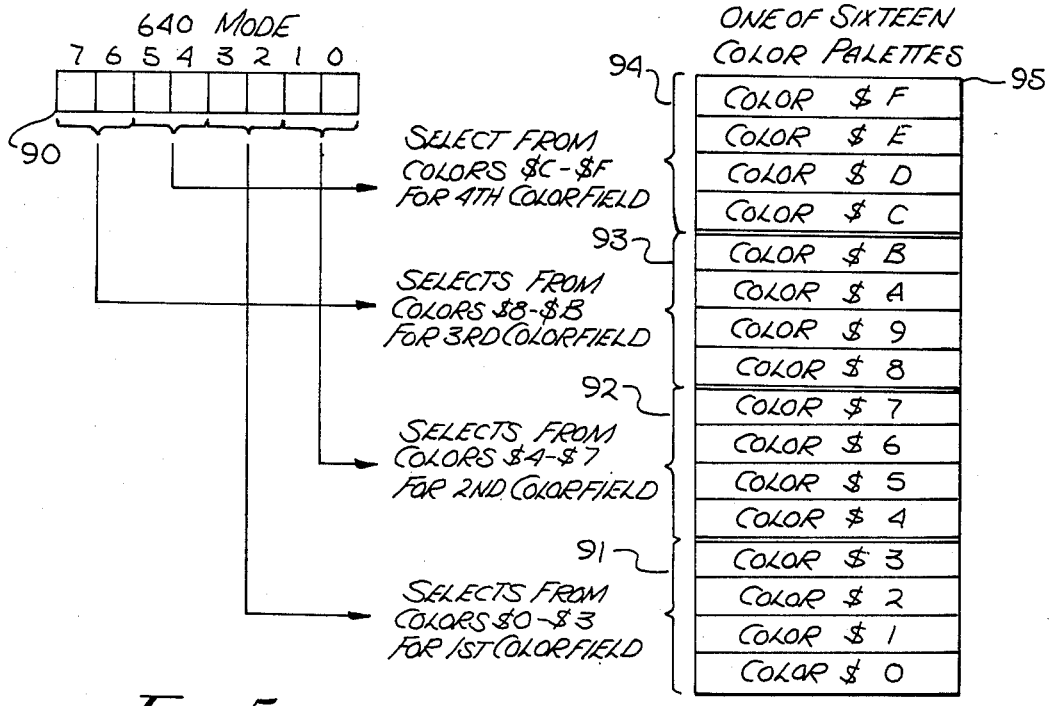
FIG. 5 illustrates subdivision of colors of a color palette for use in dithering colors of adjacent pixels.

Referring to FIG. 5, a pixel byte 90 in 640 mode is shown. Pixel byte 90 is equivalent to byte 71 except that byte 90 is operating in the 640 mode. A palette 95 containing 16 colors is subdivided into four segments of four colors apiece. Segment 91 contains colors 0–3, segment 92 contains colors 4–7, segment 93 contains colors 8–B, and segment 94 contains colors C–F. In the 640 mode, each byte 90 contains information for four color fields, as compared to two color fields for byte 71 in the 320 mode. In the 320 mode, four bits were allocated per color field allowing each color field to select one of 16 colors from a color palette. However, in the 640 mode, only two bits are allocated to each color field allowing each color field to select from one of four colors. Therefore, when in the 640 mode, bits 2 and 3 of byte 90 are set to automatically select from colors 0–3 of segment 91. Bits 0 and 1 select colors 4–7 for the second color field, bits 7 and 8 select from colors 8-B for the third color field, and bits 4 and 5 select from colors C-F for the fourth color field.

The advantage of the 640 color palette mapping mode is appreciated when used in a dithering operation to provide higher color resolution. Dithering is the process of providing two different colors to two consecutive pixels on a display wherein a third color is perceived by the viewer because of the proximity of the two pixels in reference to each other. The 640 mode in this instance uses the dithering technique to produce a variant color. Whereas in the 320 mode of the preferred embodiment each color field controls the color of two pixels, in the 640 mode each color field controls one pixel.

Referring again to FIG. 3, bit 6 of byte 70 generates an interrupt when set to one. When operating normally (interrupt status=0), the pixel bit map of segment 62 is updated at the end of each display frame. However, when interrupt status bit is set to 1 for a particular scan line, the pixel bit map portion containing graphics information for the previous lines will be updated during the display mode. By using the interrupt status bit, segment 62 need not be updated completely at the end of each frame, rather scan lines may be updated during the display. Therefore, by using the interrupt status bit of byte 70, once an object is displayed on the screen, it can be updated prior to the end of the frame, allowing for much more time for the processor to update the display.

Referring to FIGS. 2 and 3, pipeline 31 processes the new video mode by accepting the sixteen 12-bit color words for each palette from memory 63 and writing it in RAM 19. When pixel information is read from memory 63, pipeline 31 processes each four bits onto line 29 to address one of the colors stored in RAM 19. The RAM 19 address is repeated if a value of zero is detected during the color fill mode. Pipeline 31 also segments the accessing of RAM 19 when in the 640 mode.

The timing cycle of each scan line cycle is controlled by the video counter 40 which provide the video cycle count to pipeline 31 as well as to RAM address generator 45. RAM address generator 45 is enabled during the display of each scan line to generate addresses for segment 62. The new pointer information is loaded into circuit 46, which then controls the loading of one of the palettes into RAM 19, as well as controlling the setting of switches for the color fill mode, pixel mode selection and interrupt status.

Thus, an enhanced video graphics controller capable of providing several video signals, including a new and enhanced digital RGB mode has been described.

We claim:

1. In a computer system which includes a host microprocessor and provides a video display, a video graphics controller for receiving information from said host microprocessor and for generating a video color signal for said display comprising:

a first memory for storing a plurality of color palettes, each color palette having a predetermined number of color control words which control generation of said video color signal for said display;

said first memory further including a plurality of pointer words, wherein each of said pointer words includes a predetermined number of bits for selecting at least one of said palettes for each scan line of said display;

said first memory further including a plurality of data fields, wherein each of said data fields provides display information for a predetermined number of pixels;

a second memory for storing said at least one of said palettes corresponding to a current scan line of said display, such that said data fields for each scan line addresses color control words stored in said second memory;

control means coupled to said first and second memories for addressing said memories and also for providing synchronizing signals to said display;

said control means selecting for each said scan line of said display a corresponding pointer which then selects said at least one of said palettes determined by said predetermined number of bits, loading said selected said at least one of said palettes into said second memory, reading corresponding data fields from said first memory, wherein said data fields address said color control words of said at least one of said palettes stored in said second memory to provide color for said current scan line;

said control means further allowing loading of said predetermined number of bits of said pointer words with pointer information anytime using processor memory cycles, such that different said palettes may be selected and loaded into said second memory for consecutive said scan lines.

2. The video graphics controller as defined in claim 1 wherein said control means further includes a comparison means for comparing said data field to a certain predetermined value; and when said comparison results in a match, said control means repeats a previously selected color control word.

3. The video graphics controller as defined in claim 1, wherein said control means further includes a partitioning means for subdividing said at least one of said palettes stored in said second memory into sections and subdividing each data field into groupings of bits, such that each said groupings of bits selects color control words from a different section of said second memory.

4. The video graphics controller as defined in claims 2 or 3, wherein said pixels are bit mapped by said data fields.

5. The video graphics controller as defined in claim 4, wherein said first and second memories are programmable.

6. The video graphics controller as defined in claim 5, wherein said control means further includes a first counter and a second counter; said first counter maintaining a count of each scan line of said display and said second counter maintaining a count of each pixel field of each line of said display; and wherein said synchronizing signals provide synchronization between said counters and said display.

7. The video graphics controller as defined in claim 6, wherein said data fields are stored contiguously, such that said bit mapping represents a linear translation of each succeeding pixel.

8. The video graphics controller as defined in claim 7, wherein said first memory contains sixteen palettes and each said palette stores sixteen color control words.

9. The video graphics controller as defined in claim 8, wherein each said color control word provides a digitally coded red-green-blue (RGB) video signal for controlling red, green and blue colors of said display.

10. The apparatus as defined in claim 9, further including a digital-to-analog converter for converting said digitally coded RGB video signal to an analog RGB video signal.

11. The apparatus as defined in claim 10, further including a composite video circuit for converting said analog RGB video signal to a composite video signal.

12. The apparatus as defined in claim 11, wherein said color control word is 12-bits long.

13. In a computer system which includes a host microprocessor and provides a color video display, a video graphics controller for receiving information from said host microprocessor and for generating a red-green-blue (RGB) video signal for said color display comprising;

a first memory for storing a plurality of color palettes, wherein each said color palette has a predetermined number of digital color control words, each said color control word having sixteen bits, including four bits each for controlling red, green and blue colors of said RGB video signal;

said first memory further including a plurality of pointer words, wherein each of said pointer words includes a four bit color palette selection byte for selecting one of said palettes in said first memory for each scan line of said display;

said first memory further including bit mapped video data fields, wherein each of said video data fields addresses one of said color control words for a predetermined number of pixels;

a second memory for storing said palette selected by said pointer and;

a video generation circuit for converting said color control words to provide said color display;

control means coupled to said first and second memories and said video generation circuits, said control means selecting a respective pointer from said memory for each scan line of said display, loading said selected palette into said second memory; reading corresponding data fields from said first memory, wherein said data fields address said color control words of said selected palette stored in said second memory to provide a bit mapped color representation of data fields for each said scan line;

said control means allowing loading of said four bit color palette selection byte with pointer information anytime using processor memory cycles, such that various said palettes may be selected and loaded into said second memory for consecutive said scan lines.

14. The video graphics controller as defined in claim 13, wherein said data field is comprised of eight bits and said control means partitions said selected palette loaded into said second memory into four sections, such that first two bits of said data field select from colors in a first section of said selected palette, second two bits of said data field select from colors in a second section of said selected palette, third two bits of said data field select from colors in a third section of said selected palette and last two bits of said data field select from colors in a fourth section of said selected palette.

15. The video graphics controller as defined in claim 14, further including a comparison means, wherein when a fill mode is programmed in said pointer, said comparison means compares said color control word for a prdetermined value, and if a match occurs, causes a previously displayed color to be repeated.

16. The video graphics controller as defined in claim 15 further including a third memory for storing predetermined color control words and a register coupled to said third memory, said register controls selection of one of said predetermined color control words of said third memory for displaying text and said register also controls selection of one of said predetermined color control words of said third memory for displaying background color, and register and third memory coupled to said control means.

17. The video graphics controller as defined in claim 14, wherein said memory is updated by said host microprocessor during a blanking period but when an interrupt is programmed in said pointer, said host microprocessor updates said first memory also during a display cycle.

18. A method for converting a digital computer signal from a host microprocessor to a color video display signal comprising the steps of:

(a) loading digital color word which represent colors into a first memory;

(b) sectioning said digital color words into a plurality of color palettes;

(c) loading digital pointer words which provide instructions for each scan line of a display;

(d) loading digital data words which represent pixel color information for each pixel of a frame of said display;

(e) selecting a pointer for a corresponding scan line of said display;

(f) selecting one of said palettes determined by said selected pointer of step (e);

(g) selecting one of said colors from said selected palette for each pixel determined by said data field, each data field addressing one of said colors from said selected palette;

(h) repeating step (g) for all pixels of said corresponding scan line;

(i) optionally repeating step (c) through (f) for each said scan line;

(j) repeating steps (e) through (i) until a complete frame is displayed.

19. The method defined by claim 18, further including the step of sectionalizing said selected palette such that each grouping of bits of said data field selects colors from a different section of said selected palette.

20. The method defined by claim 18, wherein a previous color is repeated on said display when a fill mode is selected and said data field has a predetermined value.

21. The method defined by claim 20, wherein said predetermined value is zero.

* * * * *